US006378632B1

(12) United States Patent
Dewey et al.

(10) Patent No.: US 6,378,632 B1
(45) Date of Patent: Apr. 30, 2002

(54) REMOTELY OPERABLE HYDRAULIC UNDERREAMER

(75) Inventors: Charles H. Dewey, Houston; James E. Saylor, Kingwood, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/428,803

(22) Filed: Oct. 28, 1999

Related U.S. Application Data

(60) Provisional application No. 60/106,252, filed on Oct. 30, 1998.

(51) Int. Cl.[7] ..... E21B 7/28; E21B 10/32

(52) U.S. Cl. ..... 175/269; 175/289; 175/291

(58) Field of Search ..... 175/62, 266, 267, 175/269, 291, 286, 288, 289

(56) References Cited

U.S. PATENT DOCUMENTS

| | | | | | |
|---|---|---|---|---|---|
| 336,187 | A | * | 2/1886 | Kanmmerer, Jr. | 175/267 |
| 2,758,819 | A | * | 8/1956 | Kammerer, Jr. | 175/267 |
| 3,224,507 | A | * | 12/1965 | Cordary et al. | 166/55.8 |
| 3,365,010 | A | * | 1/1968 | Howell et al. | 175/286 |
| 3,425,500 | A | * | 2/1969 | Fuchs | 175/269 |
| 3,433,313 | A | * | 3/1969 | Brown | 175/270 |
| 3,749,187 | A | * | 7/1973 | Leathers | 175/269 |
| 4,055,226 | A | * | 10/1977 | Weber | 175/273 |
| 4,141,421 | A | * | 2/1979 | Gardner | 175/263 |
| 4,458,761 | A | * | 7/1984 | Van Vreeswyk | 166/289 |
| 4,589,504 | A | * | 5/1986 | Simpson | 175/267 |
| 4,660,657 | A | * | 4/1987 | Furse et al. | 175/269 |
| 4,889,197 | A | * | 12/1989 | Boe | 175/267 |
| 4,915,181 | A | * | 4/1990 | Labrosse | 175/263 |
| 5,086,852 | A | * | 2/1992 | van Buskirk | 175/269 |
| 5,139,098 | A | * | 8/1992 | Blake | 175/269 |
| 5,368,114 | A | * | 11/1994 | Tandberg et al. | 175/267 |

* cited by examiner

*Primary Examiner*—David Bagnell
*Assistant Examiner*—Jennifer H Gay
(74) *Attorney, Agent, or Firm*—Conley, Rose & Tayon, P.C.

(57) ABSTRACT

An underreamer opens a borehole below a restriction that is larger than the restriction itself. The underreamer includes cutters which engage the formation by traversing outward and upward. The force pushing the cutters to the extended position is supplied by a piston built into each cutter support. Pressure acting on these pistons comes from the pressure differential between the annulus and drill string during circulation of drilling fluid. The cutters are supported on both sides of the cutting structure by arms that are supported by and in sliding contact with the body. A spring opposes the upward and outward motion of the cutter mechanism and returns the cutters to their collapsed position in the absence of differential pressure. The body of the tool incorporates by-pass ports for transmitting fluid through the tool to the remainder of the bottom hole assembly.

20 Claims, 3 Drawing Sheets

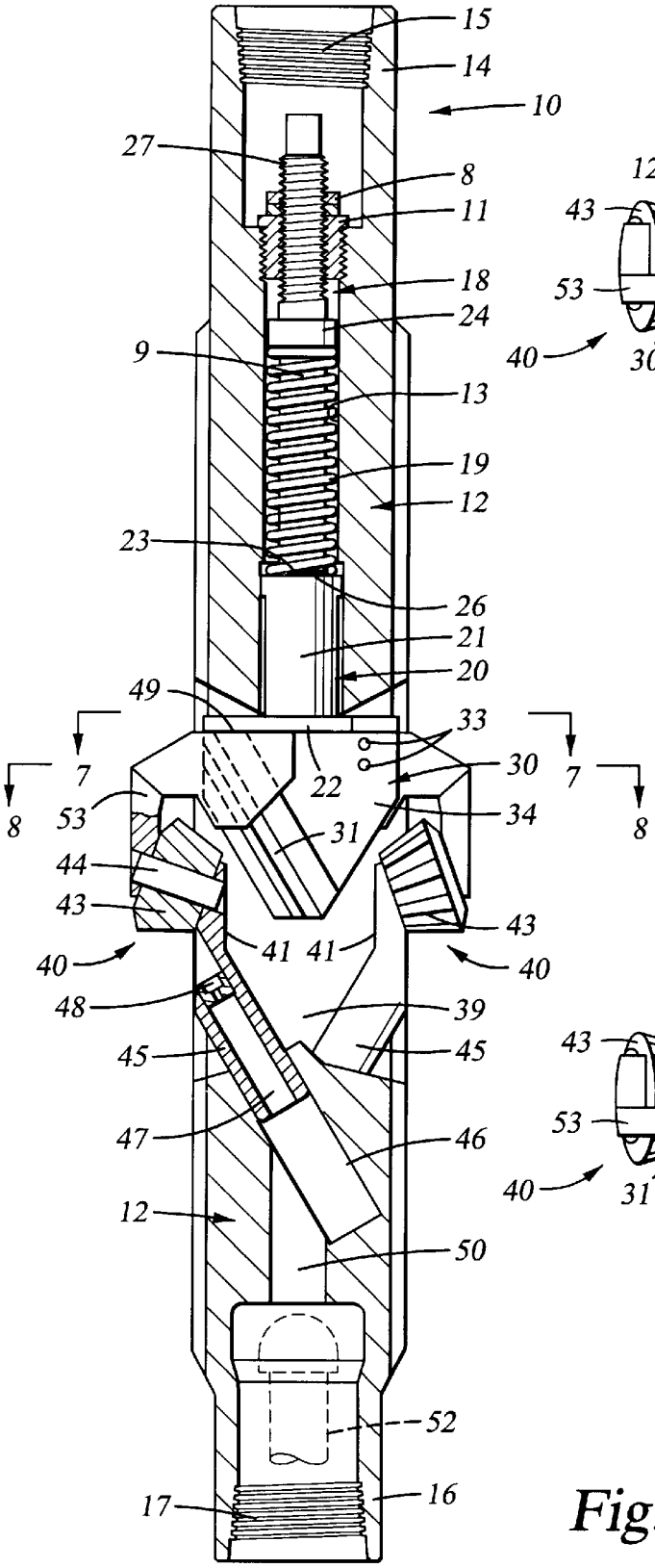
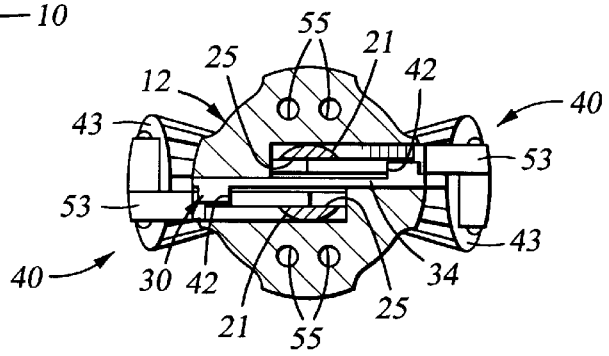
Fig. 7
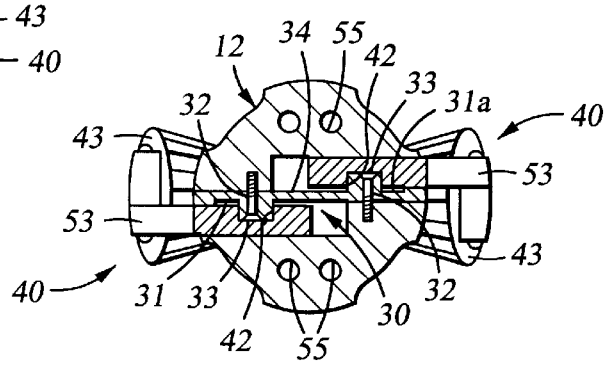
Fig. 8
Fig. 6

REMOTELY OPERABLE HYDRAULIC UNDERREAMER

CROSS-REFERENCE TO RELATED APPLICATION

The present application claims the benefit of 35 U.S.C. 111(b) provisional application Serial No. 60/106,252, filed Oct. 30, 1998, and entitled Remotely Operable Hydraulic Underreamer, hereby incorporated herein by reference.

BACKGROUND OF THE INVENTION

1. Field of the Invention

This invention relates to underreamers used to open a hole below a restriction so that the opened hole is larger than the restriction itself. More particularly, this invention relates to a hydraulically actuated underreamer in cooperation with an actuator associated therewith to remotely actuate the underreamer when fluid is circulating in a borehole. The cutter arms of the underreamer retract when fluid circulation ceases through a cutter arm retractor contained within the underreamer housing.

2. Description of the Related Art

Underreamers are used in the petroleum industry to enlarge boreholes. Such tools can be used in drilling oil, gas or water wells and in mining operations. An underreamer has basically two operative states, a closed or collapsed state where the diameter of the tool is sufficiently small to allow movement of the tool in the narrowest part of the borehole, and an open or partly expanded state where one or more arms with cutters on the ends thereof, pivot out from the body of the tool. In this latter position the borehole is enlarged as the tool is rotated and lowered in the borehole.

A drilling type underreamer is typically used in conjunction with a drill bit positioned below or downstream of the underreamer. The drill bit can drill the borehole to be underreamed at the same time as the underreamer enlarges the borehole formed by the bit. Circulation of drilling fluid to the drill bit is required to remove detritus from the bottom of the borehole and to cool and clean the bit as it drills the borehole.

Underreamers of this type usually have hinged arms with cutters attached thereto. These pivoted arms tend to break during the drilling operation and must be removed or "fished" out of the borehole before the drilling operation can continue. The tool typically has rotary cutter pocket recesses formed in the body where the arms are retracted when the tool is in a closed state. These pockets have a tendency to fill with debris from the drilling operation which makes collapsing of the arms difficult. If the arms do not fully collapse, the drill string may easily hang up in the borehole when an attempt is made to remove the string from the borehole. Most of the prior art underreamers utilize swing out cutter arms that are pivoted at an end opposite the cutting end of the reamer and are actuated by mechanical or hydraulic forces acting on the arms to extend or retract them. Typical examples of these types of underreamers are found in U.S. Pat. Nos. 3,224,507; 3,425,500 and 4,055,226.

An early example of a mechanically actuated expandable drill bit that does not use pivoting cutter arms to ream a borehole is taught in U.S. Pat. No. 3,365,010. This drill bit utilizes a pair of blade type cutters that ride in opposed, axially oriented channels. The channels are angled with respect to the axis of the bit such that when the blades impact the bottom of the borehole, shear pins retaining the blades are broken allowing the blades to move up the channels thereby expanding out against the borehole wall for subsequent borehole enlargement. A large pin for each blade retains the expanded blades in a desired position thus controlling the gage of the borehole. When the expandable drill bit is tripped out of the borehole, the blades fall down the angled tracks through frictional and gravitational forces thus diminishing the gage diameter of the expandable drill bit so that the drill string may be removed from the borehole. Once the shear pins are sheared, the expandable drill bit can only be used as a hole opener and only when the expandable drill bit is in contact with the borehole bottom.

U.S. Pat. No. 3,433,313 teaches an under-reaming tool having a tubular body with a sleeve movably positioned therein and adapted, when moved in one direction responsive to the pressure of drilling fluid, to move cutters to their opposite direction. Also responsive to the pressure of drilling fluid, the cutters are allowed to retract from their cutting position. A drilling fluid passage is formed in the tubular body to increase the flow area for drilling fluid when the cutters are in their cutting position and a means of positively moving the sleeve in the opposite direction with a wireline tool. The wireline tool is used to stop the flow of drilling fluid thus allowing the cutters to retract. This patent is disadvantaged in that a wireline device must be used to retract the cutters so that the tool may be tripped out of the borehole or to render the under-reamer inoperative downhole.

U.S. Pat. No. 5,368,114 teaches an under-reaming tool for use in preferably horizontal and extended reach boreholes. The tool includes a succession of stabilizers, underreamers and expandable stabilizers. A drilling mud activator is provided for the expandable elements of the underreamers and expandable stabilizers. The underreaming device comprises a main body with a number of guiding surfaces distributed over the circumference thereof which have a pitch angle that increases radially in an axial direction. A ring collar formed as a piston in a surrounding cylinder housing forms a small and a large radial annular surface. The piston further forms reaming pads/wings and/or stabilizer pads/wings in sliding contact with a respective guiding surface, the pads being taken up in ports in a jacket surrounding the main body in such a way that the pads can only be moved radially relative to the jacket, the jacket being attached to or formed as a part of the cylindrical housing. This patent is disadvantaged in that, in order to position the pad/wings associated with the reamer and stabilizer function, the pressure differential across the manipulating piston must be controlled and monitored by a microprocessor device positioned downhole; the information being electronically relayed to the rig platform.

Other related underreamer type patents include U.S. Pat. Nos. 4,141,421 and 4,889,197.

In general, prior art underreamers are disadvantaged in that those having cutting structures located at the end or near the end of a pivotable arm are inherently vulnerable to breakage of the pivot pins which retain the arms on the mandrel. Also, the mandrel recesses into which the cutters retract when they are collapsed tend to become easily fouled with debris during the cutting operation when the arms are extended. As a result, the arms are difficult to retract into the mandrel recesses.

Moreover, if the prior art tools are capable of transmitting fluid therethrough, it is typically accomplished using a centrally located hole or cylindrical tube. Most often, three cutters are used to dress each tool. A majority of these type tools do not positively collapse. Rather, a cutter retraction spring forces a piston to retract. The cutters however are not generally connected to the piston retraction spring and must retract through release of engagement with the borehole wall or retract through gravitational forces. The piston is usually in such a position that it is not possible to isolate fluid pressure from acting on it without preventing circulation of the drilling fluid. In other words, the tool cannot be enabled or disabled without stopping fluid circulation.

Another disadvantage of the prior art is that the cutter size and positioning are not optimized for the full range of hole opening sizes. In order to adjust the expanded diameter of a conventional underreamer, it is necessary to replace the cutting arms with larger or smaller arms or to adjust the location of their pivot points inwardly or outwardly with respect to the axis of the tool. It may even be necessary to replace the underreamer altogether with one which will provide a different expanded diameter.

Yet another disadvantage of the prior art is that the hydraulic capability is not optimized for the high fluid flow rates required.

The present invention overcomes the deficiencies of the prior art.

SUMMARY OF THE INVENTION

An expandable underreamer is disclosed which consists of an underreamer body forming at least a pair of opposed downwardly and inwardly angled slots. A means is provided to circulate fluid through the underreamer body and a means is also provided for connection to a drill string. At least a pair of cutter assemblies housed within the underreamer body is adapted to engage in the opposed angled slots formed by the underreamer body. Each cutter assembly consists of a cutter support body forming track engaging means at a first end, a piston drive means at a second end of the support body and underreaming cutter means formed therebetween. The piston is slidably engaged with a sleeve formed in the underreamer body; the sleeve being parallel with the angled slots formed in the underreamer body. The sleeve further is in fluid communication with a control port formed in the underreamer body. Fluid under pressure, when admitted to the piston sleeve below the piston drives the cutter assembly upwardly and outwardly along the angled slots to commence an underreaming operation. Spring means is additionally provided in the underreamer body to retract the cutter assemblies when fluid is shut off at the control port.

The hydraulically operated underreamer opens a borehole below a restriction that is larger than the restriction itself. The underreamer has a cutter system with a pair of cutters that engage the formation by traversing upward and outward along a track that is angled with respect to an axis of the underreamer body. The force pushing the cutters to the extended position is supplied by a piston built into each cutter support. The cutters may be actuated by a single piston acting on both the cutter support assemblies. Pressure acting on these pistons/piston comes from the pressure differential between the annulus and the drill string during circulation of the drilling fluid.

The cutters are supported on both sides of their cutting structure and are maintained in sliding contact with the underreamer body. The support arrangements on each side of the cutting structure also serve as guides for movement of the cutter assemblies with respect to the underreamer body. A spring opposes the upward and outward motion of the cutter systems and returns the cutters to the collapsed position in the absence of differential pressure (hydraulic pumps off).

An adjustment mechanism is used to set the stroke of the cutter system thereby determining the hole opening diameter.

The body of the underreamer tool incorporates by-pass ports for transmitting drilling fluid through to the remainder of the of the bottom hole drilling assembly. The bottom hole assembly could consist of mud motors, drill bits, MWD, etc.

The underreamer also contains a flow passage between the mud flow and the piston chamber that, when closed will disable the tool (it will not extend the cutters and no fluid will go through the underreamer nozzles). This feature enables the user to drill and underream simultaneously or to drill only if a hydraulic control device is incorporated with the underreamer.

The underreamer tool of the present invention utilizes by-pass ports to transmit drilling fluid through the housing of the tool. The fluid does not travel through the actuating piston to flow through the tool.

Further the underreamer uses only two cutters that enables the structure to be very strong and provides larger, more robust cutters than comparable prior art tools of approximately the same size. The two cutter configuration also allows for maximum support of the cutting structure within the body of the tool.

Still further the underreamer utilizes a pair of cutters without the conventional hinge pin associated therewith. Thus, the port area through the tool can be increased. Hence, the flow rate through the tool is substantially doubled.

An advantage of the present invention over the prior art is that the underreamer mechanism is built such that the cutters are forced to the collapsed position by a spring when there is insufficient pressure to overcome the spring force (pumps off).

Another advantage of the present invention over the prior art is that the tool utilizes fluid bypass ports to transmit fluid there through. The fluid does not travel through the piston to pass through the tool.

Still another advantage of the present invention over the prior art is the use of two cutters which enables the structure to be very strong (larger than comparable tools of the same size). The two cutter configuration of the present invention allows for maximum support of the cutting structure within the body of the underreamer tool.

Yet another advantage of the present invention over the prior art is by utilizing the two cutter design and eliminating the conventional hinge pin designs, the port area may be increased through the tool body. The allowable fluid flow rate through the present design is substantially doubled.

The above noted objects and advantages of the present invention will be more fully understood upon a study of the following description in conjunction with the detailed drawings.

BRIEF DESCRIPTION OF THE DRAWINGS

FIG. 6 is a partial cross-section of the apparatus illustrating the cutter assembly in the fully extended position, the actuating piston being forced upstream by the fluid under pressure being directed toward the moveable cutter actuation pistons connected to each of the cutter assemblies;

FIG. 7 is a view taken through 7—7 of FIG. 6; and

FIG. 8 is a view taken through plane 8—8 of FIG. 6.

DESCRIPTION OF THE PREFERRED EMBODIMENTS

Figure 1:
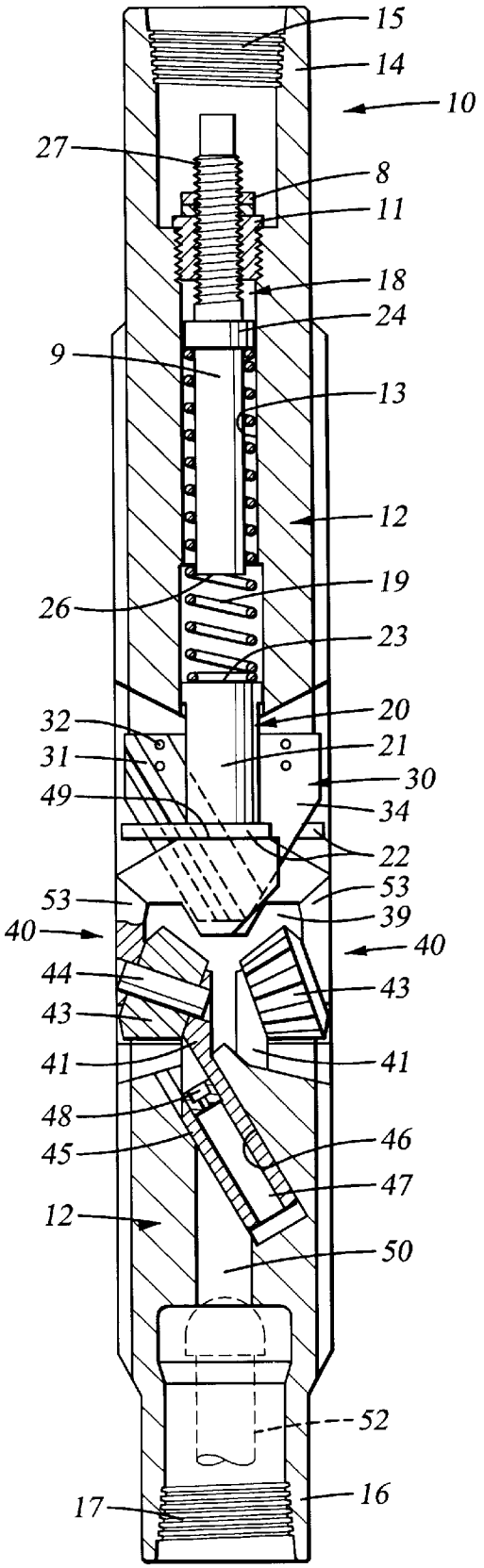
FIG. 1 is a partial cross-section of a remotely operable hydraulic underreamer apparatus.
Figure 3:
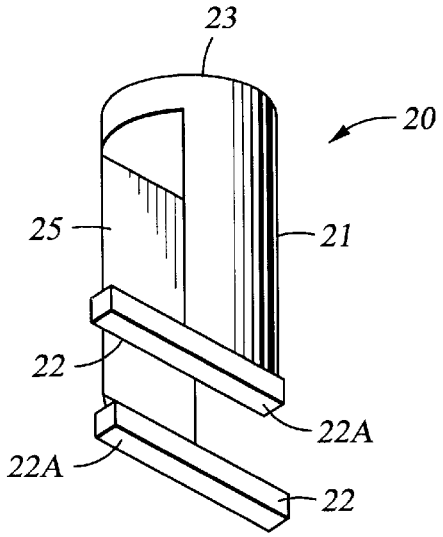
FIG. 3 is a perspective view of the cutter assembly return plunger.

Referring initially to FIGS. 1, 2, 3 and 4, the remotely operable hydraulic underreamer 10 includes a longitudinal underreamer body 12 that typically is connected to a drill string or drill string apparatus (not shown) at threaded connection 15 at upstream end 14 of body 12. The lower end 16 is affixed by a threaded connection 17 to a fluid control assembly (not shown) or other suitable components. One fluid control assembly is shown and described in U.S. patent application Ser. No. 09/183,692 filed Oct. 30, 1998, hereby incorporated herein by reference.

The body 12 contains a cutter return assembly, generally designated as 18, which includes an elongated pin 9 having a radially enlarged portion 24 and a threaded portion 27 at its upper end. The return assembly 18 is screwed into a threaded retainer 11 disposed within a conduit 13 formed in body 12. Lock nuts 8 are also supplied on the threaded end 27. The return assembly 18 includes a cutter return plunger 20 which is shown in greater detail in FIG. 3. The plunger 20 comprises a shaft 21 forming an upper end 23 and a base end 22 which is divided by a slot 25. The return assembly 18 also comprises a compressible spring 19 that is disposed within the conduit 13 between the enlarged portion 24 of pin 9 and the upper end 23 of the plunger 20. As a result, the plunger 20 is biased downward within the conduit 13.

Below the conduit 13, a cutter assembly slot 39 houses a pair of moveable cutter assemblies 40. The cutter assemblies 40 are moveable between a collapsed position, depicted in FIGS. 1 and 2, and a radially extended position, shown in FIGS. 6, 7 and 8, which is used for underreaming.

The base ends 22 of the return plunger 20 each present a translation surface 22A which contacts a complimentary translation surface 49 on the body 41 of each moveable cutter assembly 40. The plunger 20 is urged against the moveable cutter assembly 40 by the spring 19 positioned between flange 24 formed by pin 9 of return assembly 18 and end 23 of plunger body 21.

Figure 4:
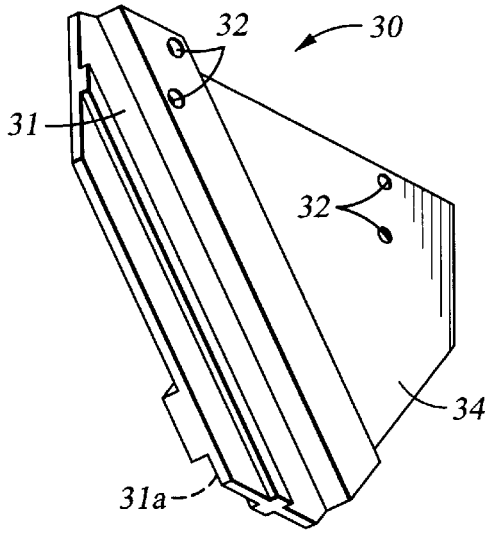
FIG. 4 is a perspective view of the cutter assembly support structure mounted to the underreamer body illustrating the angled tracks formed by the support structure that engage track runners formed by the moveable body of the cutter assembly.
Figure 2:
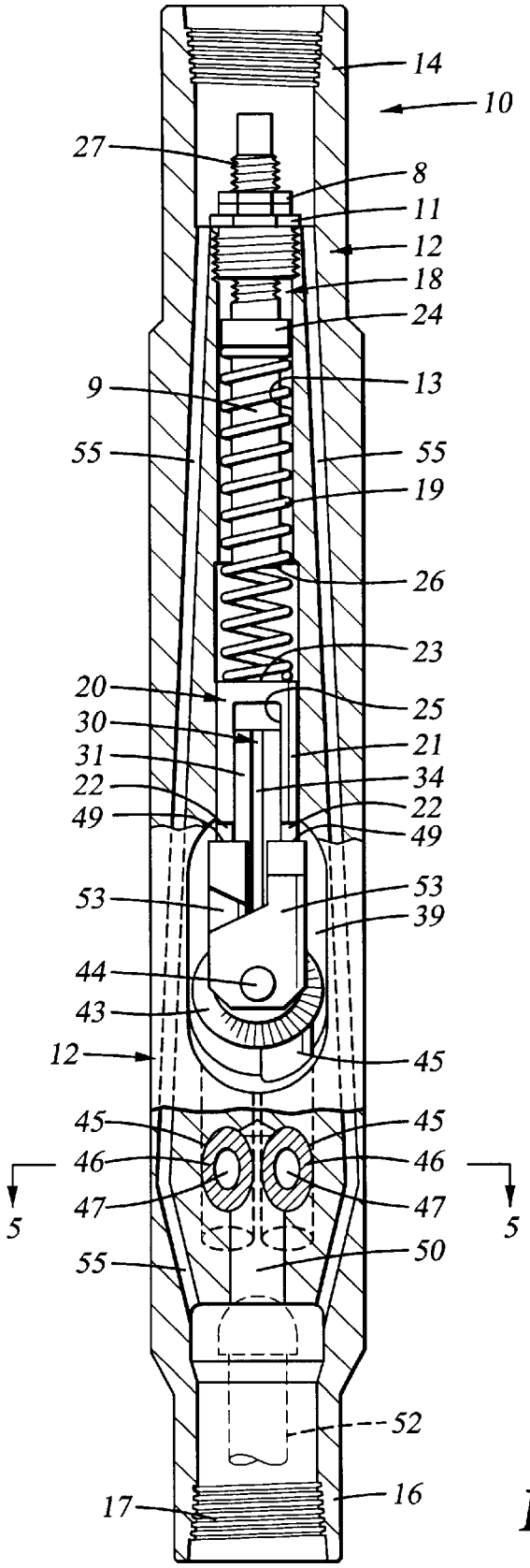
FIG. 2 is a partial cross-section of the apparatus rotated ninety degrees from FIG. 1.

A cutter assembly support structure 30, shown in detail in FIG. 4, is affixed within the underreamer body 12 to reside within the slot 25 of the plunger 20. The cutter assembly support structure 30 has a pair of angled cutter assembly tracks 31, 31*a* formed on opposite sides of the support structure 30. The support structure 30 is bolted through bolt holes 32 formed in the upper end of the body 34 to the underreamer body 12.

Located beneath the plunger 20 are a pair of moveable cutter assemblies 40. Each of the cutter assemblies 40 comprises an elongated, sleeve-like body 41 that supports a cutter 43 which is rotatably secured to a journal bearing 44.

Each cutter assembly 40 includes an angular arm 53 which is affixed to the journal bearing 44 supporting one of the rotatable cutters 43. Each angular arm 53 forms on its upper end, angled grooves 42 that are shown in FIGS. 7 and 8 and which slidably interfit with alignment tracks 31, 31*a* formed on opposite sides of body 34 of support structure 30. The journal bearing 44 is also affixed to the cutter assembly body 41 at its opposite end. The cutter 43, then, is advantageously and securely affixed within the cutter assembly 40 at two points.

Each cutter assembly 40 also includes a cutter assembly drive piston 45 that is slidably received within a sleeve 46 formed within body 12. The angle of the axis of the piston sleeve 46 is generally parallel to that formed by the corresponding grooves 42 and tracks 31 of support body 34. The slidable interface of the angled grooves 42 on angled arm 53 with the tracks 31 provides a guide for the cutter assembly 40 which helps to ensure that the assembly 40 extends upwardly and outwardly toward its radially extended position in the intended manner without becoming misaligned. This guide mechanism also helps to ensure that the cutter assembly 40 does not become misaligned as it is moved from the radially extended position to the collapsed position. Disposal of the drive piston 45 within the piston sleeve 46 provides another mechanism for guiding the cutter assembly 40 as it is extended and retracted so that the cutter assembly does not become misaligned. As a result, the cutter assembly 40 is provided with both an upper and a lower guide. Of course, the same is true with respect to the cutter assembly 40 positioned adjacent to track 31*a* on the opposite side of support body 34.

Each piston 45 defines a concentric fluid passage 47 therewithin. Fluid flow therethrough is partially blocked by a fluid restricting nozzle 48 positioned at the upper exit end of the passage 47. In effect, then, each piston 45 presents a fluid pressure receiving area upon which fluid pressure may be applied to move the piston 45, and hence the cutter assembly 40 in response thereto. A fluid inlet 50 formed in the body 12 of the underreamer 10 directs fluid to the sleeves 46 when the valve 52 (shown in phantom in a closed position) is opened by a fluid manipulating means (not shown) connected to end 16 of the underreamer. The fluid manipulating means may comprise a control device which is described in U.S. patent application Ser. No. 09/183,692, filed Oct. 30, 1998 and entitled "Fluid Flow Control Devices and Methods for Selective Actuation of Valves and Hydraulic Drilling Tools", hereby incorporated herein by reference, which has been assigned to the assignee of the present invention. In an alternative embodiment, the fluid manipulating means may be eliminated completely and the valve 52 removed or secured in an open position. In this embodiment, drilling fluid is free to enter the fluid inlet 50, and the underreamer 10 is simply controlled by selective operation of the pump located at the surface of the well.

In operation, when the valve 52 is opened (see FIG. 6) fluid under pressure is directed to the fluid pressure receiving areas formed by each of the pistons 45 affixed to the cutter assemblies 40. The restricted nozzle 48 creates sufficient back pressure to overcome the force of the spring 19 thereby forcing the cutter assembly to slide upwardly and outwardly along the parallel paths of the sleeves 46 and grooves 42 thus positioning each of the cutters 43 against the formation to enlarge or ream the borehole.

The base 22 of the plunger 20 contacts the translation surface 49 of the body 41 of the cutter assembly 40. As the cutter assemblies 40 extend radially and upwardly, the plunger 20 is pushed upwardly within the conduit 13. As the plunger 20 is pushed upwardly, its upper end 23 eventually stops against stop face 26 at the lower end of the pin 9 of return assembly 18 (see FIG. 6) thereby determining the extent of the diameter of the borehole to be reamed.

Figure 5:
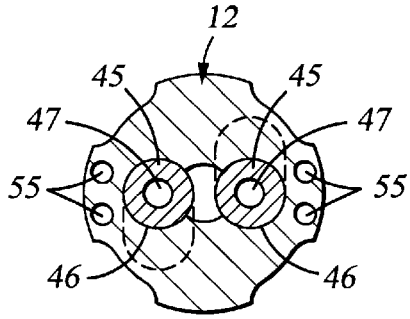
FIG. 5 is a view taken through plane 5—5 of FIG. 2.

FIG. 5 further illustrates disposition of the drive pistons 45 within their sleeves 46 as well as the location of bypass passages 55 formed in the body 12. The four fluid bypass ports 55 are clearly shown in FIGS. 5, 7 and 8 to remain clear of the internal working mechanism of the underreamer 10. The bypass passages 55 allow for the operation of other drilling tools such as drill bits and the like by directing fluid through body 12 of the underreamer 10 without interference from cutter assemblies 40. Because the fluid passages 55 are not required to be disposed around a central piston, they can be made larger than with conventional underreamers to essentially double fluid flow through body 12.

FIGS. 7 and 8 more clearly illustrate the position of each of the cutter assemblies 40 on opposite sides of the support structure 30. The grooves 42 are formed on the body 41 of the cutter assemblies 40 and engage alignment tracks 31, 31*a* formed within the body 34 of the support structure 30.

The cutter assemblies 40 are moved to a collapsed position, i.e., retracted into the slot 39 within the underreamer body 12, by force exerted by the spring 19 when the valve 52 shuts off the fluid under pressure to cutter assembly drive pistons 45. As the cutter assemblies 40 are assisted to their collapsed position by downward urging of the plunger 20 by spring 19, they are also permitted to move radially inwardly as the translation surfaces 22 of the plunger 20 contact the translation surfaces 49 of each arm 53. The surfaces 22 and 49 are capable of sliding, or translational, movement with respect to one another. As the plunger 20 and spring 19 urge the cutter assemblies 40 downwardly the arms 53 will thus translate radially inwardly with respect to the plunger 20. Hence, the cutter assemblies 40 are urged into their respective recesses 39 by the spring 19 and do not rely on gravitational forces to retract the cutters 43 (see FIGS. 1 and 2). The use of translation surfaces 22 and 49 avoids the need to rely upon pivot points and pins which are vulnerable to breakage.

Although the cutters 43 are depicted as rotary cutters, they could also be conical or cylindrical in shape and retain any number of formation cutting means such as hardened milled teeth, tungsten carbide inserts or diamond inserts. Moreover, the formation cutting means affixed to the support 41 could use non-rotating blades having cuttings means retained in the blades as pointed out with respect to the rotary cutters without departing from the teachings of the present invention.

Among the advantages to be realized by the present invention is the use of two separate fluid pressure receiving areas for independent actuation of the two cutter assemblies. Because fluid pressure is applied to the cutter assemblies 40 from below rather than above, the cutter assemblies move upwardly and radially outwardly as they move toward their radially expanded positions.

Further, construction in accordance with the present invention provides for a rugged and strong underreamer design. Specifically, the cutter assemblies feature attachment at two points. There are no pivot pins to potentially break off during operation of the underreamer. The use of the alignment tracks 31 ensures that alignment of the cutter assemblies 40 with respect to the underreamer body 12 is maintained so that the cutter assemblies 40 are not bent or twisted about the longitudinal axis of the underreamer body 12.

Adjustment of the threaded end 27 within retainer 11 and lock nuts 8 upon the threaded end 27 of pin 9 can be used to precisely determine the radial distance from the central axis of the body 12 to the cutting face 43*a* of a cutter 43 in its extended position. The threaded end 27 is then turned using a wrench to move the pin 9 upward or downward within the conduit 13. The upward or downward movement of the pin 9 adjusts the axial position of the stop face 26 within the conduit 13, thereby adjusting the limit of movement for the upper end 23 of the return plunger 20 as the underreamer 10 is moved to its expanded position. When upward movement of the plunger 20 is limited to a greater extent by downward movement of the pin 9 within the conduit 13, the distance to which the cutter assemblies 40 are able to be radially extended is correspondingly limited. Conversely, upward movement of the pin 9 within the conduit 13 allows the cutter assemblies 40 to move radially outwardly to a greater extent. Adjustment of the location for pin 9 in this manner thus results in the diameter of the tool with the cutter assemblies 40 to be adjusted to conform to a desired diameter. Precise adjustment of the movement of the cutter assemblies 40 is accomplished by placing a ring gage, of a type known in the art for the measurement of tool diameter, across the diameter of the cutter assemblies 40 when the cutter assemblies 40 are placed in a radially expanded position as is illustrated in FIG. 6. The axial location of the pin 9 is then adjusted until the diameter of the expanded cutters essentially matches that of a desired hole opening diameter, as measured by the ring gage. In this manner, an underreamer constructed in accordance with the present invention is capable of being easily adjusted to expand to a variety of different radial sizes without the need to remove parts and replace them.

It will of course be realized that various modifications can be made in the design and operation of the present invention without departing from the spirit thereof. It would, for example, be obvious to one skilled in the art to design the underreamer with more than a pair of cutters without departing from the scope of this invention. Thus, while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. An underreamer comprising:

an underreamer body;

first and second cutter assemblies slidably disposed within the body for selective movement between a collapsed position and a radially extended position;

each said cutter assembly presenting a fluid pressure receiving area and movable from the collapsed position to the radially extended position upon application of fluid pressure to said fluid pressure receiving area.

2. The underreamer of claim 1 wherein each of said cutter assemblies comprises:

a generally cylindrical piston-driven shaft having two ends and which presents said fluid pressure receiving area at one end; and a cutter affixed to the other end.

3. The underreamer of claim 1 further comprising a cutter return assembly for urging at least one of said cutter assemblies from the radially expanded position to the collapsed position, the return assembly comprising a spring-biased return plunger having a translation surface adapted to contact a portion of one of said cutter assemblies and urge said assembly downwardly and to permit lateral translation of the cutter assembly with respect to the return plunger.

4. The underreamer of claim 3 further comprising a pair of cutter assembly guides which help align the cutter assembly as it is expanded and contracted.

5. The underreamer of claim 1 wherein said underreamer body contains fluid bypass passages to direct fluid through said underreamer body without interference with said cutter assemblies.

6. The underreamer of claim 5 further comprising a valve that controls the flow of fluid from said bypass passages to said pressure receiving area.

7. An underreamer comprising:

an underreamer body;

first and second cutter assemblies slidably disposed within the body for selective movement between a collapsed position and a radially extended position;

each said cutter assembly presenting a fluid pressure receiving area and movable from the collapsed position to the radially extended position upon application of fluid pressure to said fluid pressure receiving area;

a cutter return assembly for urging at least one of said cutter assemblies from the radially expanded position to the collapsed position, the return assembly comprising a spring-biased return plunger having a translation surface adapted to contact a portion of one of said cutter assemblies and urge said assembly downwardly and to permit lateral translation of the cutter assembly with respect to the return plunger;

a pair of cutter assembly guides which help align the cutter assembly as it is expanded and contracted wherein the pair of cutter assembly guides comprise:

a first guide disposed above the cutter assembly; and a second guide disposed below the cutter assembly.

8. An adjustable underreamer comprising:

an underreamer body having a longitudinal axis;

a cutter assembly disposed within the body and selectively movable between a collapsed position and a radially expanded position, the cutter assembly having at least one cutter; and an adjustment member of the cutter assembly to locate the cutter a predetermined radial distance from the axis when the cutter assembly is moved to its radially expanded position, said adjustment member being adjustable on said underreamer body to adjust said predetermined radial distance.

9. The underreamer of claim 8 wherein the adjustment member comprises a stop face which prevents further radial outward movement of the cutter assembly.

10. The underreamer of claim 9 wherein the stop face is disposed within the underreamer body and is axially moveable to adjust the radial distance between the cutter and the axis.

11. The underreamer of claim 8 wherein the cutter assembly is disposed angularly within the underreamer body and moves toward its radially expanded position in an upward and radially outward direction.

12. The underreamer of claim 8 wherein each said cutter assembly includes a fluid pressure receiving area for movement from the collapsed position to the radially extended position upon application of fluid pressure to said fluid pressure receiving area and said underreamer body contains fluid bypass passages to direct fluid through said underreamer body without interference with said cutter assemblies.

13. The underreamer of claim 12 further comprising a valve that controls the flow of fluid from said bypass passages to said pressure receiving area.

14. An adjustable underreamer comprising:

an underreamer body having a longitudinal axis;

a cutter assembly slidably disposed within the body and selectively movable between a collapsed position and a radially expanded position, the cutter assembly having at least cutter; and an adjustment member of the cutter assembly to locate the cutter at a predetermined radial distance from the axis when the cutter assembly is moved to its radially expanded position; and wherein the cutter assembly comprises a rotable cutter which is affixed to the cutter assembly at two points.

15. An adjustable underreamer comprising:

an underreamer body having a longitudinal axis;

a cutter assembly disposed within the body and selectively movable between a collapsed position and a radially expanded position, the cutter assembly having at least one cutter; and an adjustment member of the cutter assembly to locate the cutter at a predetermined radial distance from the axis when the cutter assembly is moved to its radially expanded position;

a cutter assembly support comprising:

a support body; and an angled cutter assembly alignment track disposed within the support body to engage a generally complimentary alignment track on said cutter assembly.

16. The underreamer of claim 15 wherein the cutter assembly includes a groove formed to be generally complimentary to and to slidably engage said cutter assembly alignment track.

17. The underreamer of claim 16 wherein the cutter assembly further comprises a piston slidable disposed within a portion of the underreamer body.

18. An adjustable underreamer comprising:

an underreamer body having a longitudinal axis;

a cutter assembly slidably disposed within the body and selectively movable between a collapsed position and a radially expanded position; said cutter assembly comprising:

a body;

a bearing attached to said body at each end; and a cutter rotatably attached to said bearing.

19. The underreamer of claim 18 wherein said underreamer body contains fluid bypass passages to direct fluid through said underreamer body without interference with said cutter assemblies.

20. The underreamer of claim 19 further comprising a valve that controls the flow of fluid from said bypass passages to said pressure receiving area.

* * * * *